US009487363B2

(12) United States Patent
Aoyama

(10) Patent No.: US 9,487,363 B2
(45) Date of Patent: Nov. 8, 2016

(54) SHEET FEEDER AND IMAGE FORMING APPARATUS INCORPORATING SAME

(71) Applicant: Jumpei Aoyama, Kanagawa (JP)

(72) Inventor: Jumpei Aoyama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/803,476

(22) Filed: Jul. 20, 2015

(65) Prior Publication Data

US 2015/0321863 A1 Nov. 12, 2015

Related U.S. Application Data

(63) Continuation of application No. 14/089,922, filed on Nov. 26, 2013, now Pat. No. 9,126,781.

(30) Foreign Application Priority Data

Dec. 27, 2012 (JP) ..... 2012-284631

(51) Int. Cl.

| | |
|---|---|
| ***B65H 1/04*** | (2006.01) |
| ***B65H 3/06*** | (2006.01) |
| ***G03G 15/00*** | (2006.01) |

(Continued)

(52) U.S. Cl.

CPC ..... *B65H 3/0684* (2013.01); *B65H 1/04* (2013.01); *B65H 3/0615* (2013.01); *B65H 3/44* (2013.01); *B65H 5/06* (2013.01); *G03G 15/6514* (2013.01); *B65H 2405/324* (2013.01); *B65H 2407/21* (2013.01)

(58) Field of Classification Search

CPC .. B65H 1/04; B65H 2407/21; B65H 3/0684; G03G 15/6514; G03G 2215/00392

See application file for complete search history.

(56) References Cited

U.S. PATENT DOCUMENTS 6,217,018 B1 * 4/2001 Tay ..... B65H 1/266 271/145

7,156,389 B2 1/2007 Kadowaki et al.

(Continued)

FOREIGN PATENT DOCUMENTS

CN 1485215 A 3/2004

CN 1749138 A 3/2006

(Continued)

OTHER PUBLICATIONS

Office Action for corresponding Chinese Patent Application No. 201310712005.2 issued on Sep. 2, 2015.

(Continued)

*Primary Examiner* — Luis A Gonzalez

(74) *Attorney, Agent, or Firm* — Harness, Dickey & Pierce, P.L.C.

(57) ABSTRACT

A sheet feeder, which is included in an image forming apparatus, includes a sheet bypass member openably closable to one side surface of a body of the image forming apparatus, a pickup roller to feed and convey a sheet loaded on the sheet bypass member, and an arm to hold the pickup roller and to open and close with the pickup roller. The arm includes a contact portion extending in a shape of projection toward an upstream side from the pickup roller in a sheet conveying direction of the sheet bypass member. As the sheet bypass member is rotated upward to be closed and stored to the side surface of the body, the contact portion of the arm contacts the sheet bypass member to rotate the arm upward to cause the sheet bypass member to approach to the side surface of the body.

12 Claims, 5 Drawing Sheets

(51) Int. Cl.

| | |
|---|---|
| ***B65H 5/06*** | (2006.01) |
| ***B65H 3/44*** | (2006.01) |

(56) References Cited

U.S. PATENT DOCUMENTS

| | | | |
|---|---|---|---|
| 7,668,501 | B2 | 2/2010 | Murakami et al. |
| 7,971,866 | B2 | 7/2011 | Huang et al. |
| 8,376,350 | B2 | 2/2013 | Choi |
| 2005/0073087 | A1 | 4/2005 | Kadowaki et al. |
| 2005/0254873 | A1 | 11/2005 | Murakami et al. |
| 2006/0071399 | A1 | 4/2006 | Asada et al. |
| 2007/0081199 | A1 | 4/2007 | Koga et al. |
| 2010/0025916 | A1 | 2/2010 | Kusumi |
| 2012/0074636 | A1 | 3/2012 | Choi |
| 2013/0161897 | A1 | 6/2013 | Matsumoto |

FOREIGN PATENT DOCUMENTS

| | | | |
|---|---|---|---|
| CN | 1923648 | A | 3/2007 |
| CN | 101638184 | A | 2/2010 |
| CN | 102530588 | A | 7/2012 |
| JP | H07-41190 | A | 2/1995 |
| JP | H08-259050 | A | 10/1996 |
| JP | H09-263336 | A | 10/1997 |
| JP | H10-139178 | A | 5/1998 |
| JP | H11-171360 | A | 6/1999 |
| JP | 2013-129481 | A | 7/2013 |

OTHER PUBLICATIONS

Office Action for corresponding Japanese Patent Application No. 2012-284631 issued on Jul. 22, 2016.

* cited by examiner

SHEET FEEDER AND IMAGE FORMING APPARATUS INCORPORATING SAME

CROSS-REFERENCE TO RELATED APPLICATIONS

This patent application is a continuation of U.S. application Ser. No. 14/089,922, filed on Nov. 26, 2013, which is based on and claims priority pursuant to 35 U.S.C. §119 to Japanese Patent Application No. 2012-284631, filed on Dec. 27, 2012 in the Japan Patent Office, the entire disclosure of each of which is hereby incorporated by reference herein.

BACKGROUND

1. Technical Field

Embodiments of the present invention relate to a sheet feeder that includes a storable bypass member and a pickup roller to feed a sheet for receiving an image thereon, and an image forming apparatus incorporating the sheet feeder.

2. Related Art

Known image forming apparatuses include a sheet feeder that includes an openably storable manual bypass and a pickup roller, so that a recording medium such as a sheet is fed by the manual bypass and the pickup roller to a sheet feeding portion.

However, if a sheet conveying direction and a roller protruding direction of the pickup roller are same as a direction of a machine width of an image forming apparatus, the manual bypass is arranged to be stored out of space for storing the pickup roller in the direction of the machine width. Therefore, a sheet conveying path, the pickup roller, a feed roller and the like are disposed out of a body of the image forming apparatus, which increases the size of the image forming apparatus.

Japanese Patent No. JP-3328486-B (Japanese Patent Application Publication No. JP-H08-259050-A) discloses that a sheet standby position is varied by linking movement of open/close of the manual bypass, such that the pickup roller is used for both the manual bypass and a lower sheet container. However, the manual bypass is still stored outside the space for the pickup roller in the machine width. Therefore, the width of the image forming apparatus remains wide by the place to store the manual bypass.

SUMMARY

The present invention provides an optical scanner including a sheet bypass member openably closable with respect to one side surface of a body of an image forming apparatus, a pickup roller to feed and convey a sheet loaded on the sheet bypass member to a subsequent operation, and an arm to hold the pickup roller and to open and close together with the pickup roller to the side surface of the body. The arm includes a contact portion extending in a shape of projection toward an upstream side from the pickup roller in a sheet conveying direction of the sheet bypass member. As the sheet bypass member is rotated upward to be closed and stored to the side surface of the body, the contact portion of the arm contacts the sheet bypass member to rotate the arm upward to cause the sheet bypass member to approach to the side surface of the body.

Further, the present invention provides an image forming apparatus including a body having a recessed portion arranged on one side surface thereof and the above-described sheet feeder.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
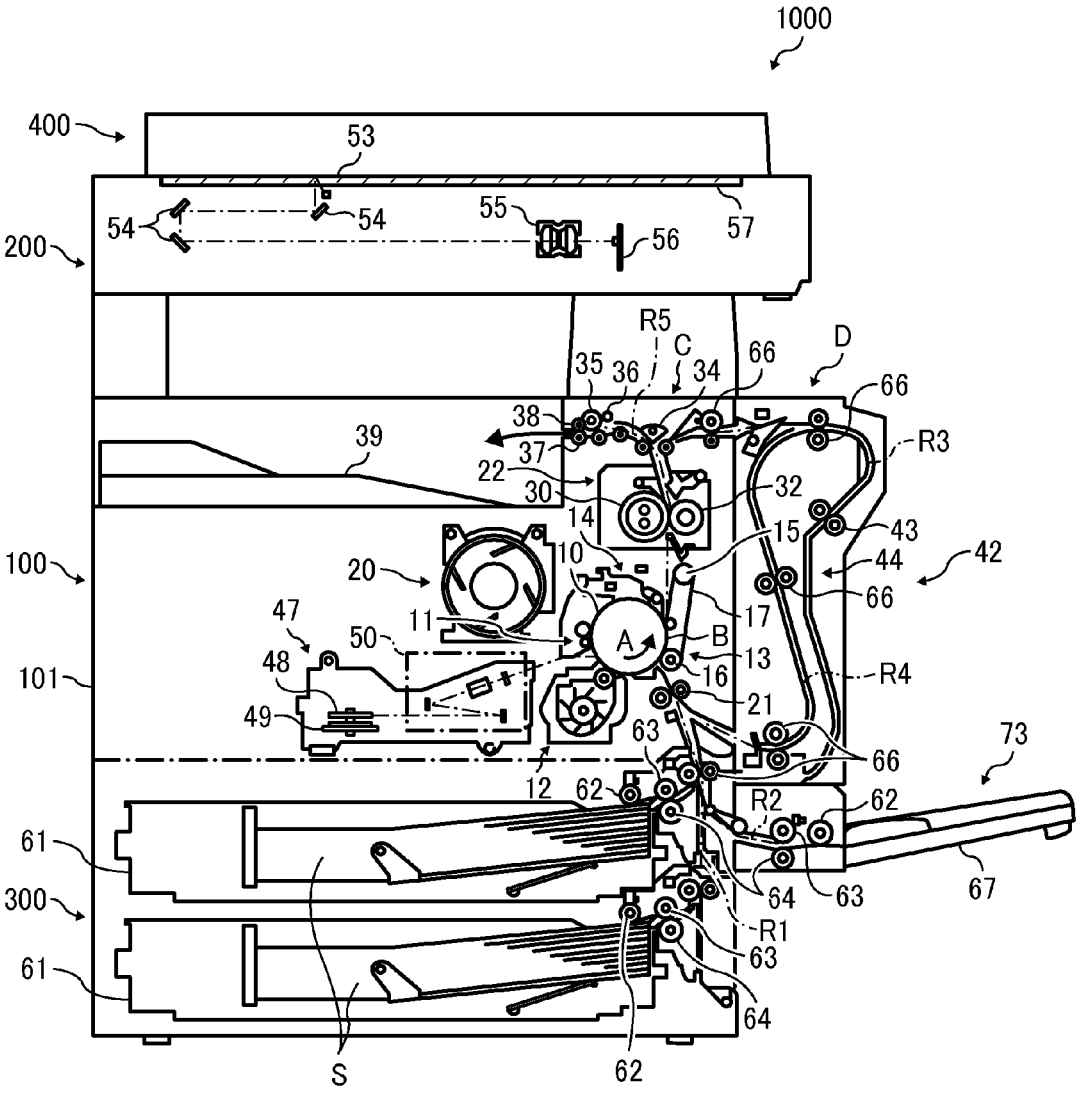
FIG. 1 is a schematic diagram illustrating a configuration of an image forming apparatus according to Embodiment 1.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items. Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

Embodiments described below relate to a sheet feeder and an image forming apparatus including the sheet feeder. The image forming apparatus may be a copier, a printer, a facsimile machine, and a multifunctional machine including functions of at least the copier, the printer, and the facsimile machine. The present invention is not limited to the embodiments to be described below with reference to the drawings.

[Embodiment 1]

A description is given of a configuration and functions of an image forming apparatus 1000 according to an embodiment of the present invention, with reference to FIG. 1.

FIG. 1 is a schematic diagram illustrating a configuration of the image forming apparatus 1000 according to Embodiment 1. The image forming apparatus 1000 includes a sheet feeding mechanism 300 that includes a manual bypass feeder 73.

The image forming apparatus 1000 may be a copier, a facsimile machine, a printer, a multifunction peripheral or a multifunction printer (MFP) having at least one of copying, printing, scanning, facsimile, and plotter functions, or the like. According to the present embodiment, the image forming apparatus 1000 is an electrophotographic color copier that forms color and monochrome toner images on recording media by electrophotography.

The image forming apparatus 1000 includes an image forming mechanism 100, an image reading mechanism 200, the sheet feeding mechanism 300, and an automatic document feeder (ADF) 400. The image forming mechanism 100 is disposed below the image reading mechanism 200. The sheet feeding mechanism 300 of tray type is disposed below the image forming mechanism 100 and the image reading mechanism 200. The openably closable ADF 400 is disposed above the image reading mechanism 200. The image forming mechanism 100 and the sheet feeding mechanism 300 are contained in an apparatus body 101.

The image forming mechanism 100 includes a drum-shaped photoconductor 10 that functions as an image carrier provided therein. Image forming units and components are disposed around the photoconductor 10. For example, the units and components are a charger 11, a development unit 12, a transfer unit 13, and a cleaning unit 14 disposed in this order along a rotation direction of the photoconductor 10. In this case, the photoconductor 10 rotates counterclockwise as indicated by arrow A in FIG. 1. The transfer unit 13 includes a transfer belt 17 that is wound about rollers 15 and 16. The transfer belt 17 is pressed against a surface of the photoconductor 10 at a transfer position B.

A toner supply unit 20 is disposed at a left side of the charger 11 and the cleaning unit 14 in FIG. 1 to supply new toner to the development unit 12.

The image forming mechanism 100 further includes a sheet conveying unit C therein to feed a sheet functioning as a recording medium such as a regular paper and an overhead projector (OHP) sheet from a sheet feeding position and convey the sheet to a sheet stacking position via the transfer position B. The sheet conveying unit C includes a sheet feeding path R1, a bypass sheet feeding path R2, and a sheet conveying path R5. The sheet conveying path R5 extends from a portion adjacent to a registration roller pair 21 through a portion between the photoconductor 10 and the transfer unit 13 and runs upwardly and turns left toward a sheet discharging stacker (a sheet discharging position) 39 as illustrated in FIG. 1, which forms a substantially L shape.

As described above, the sheet conveying path R5 includes the registration roller pair 21 disposed upstream from the photoconductor 10 in a sheet conveying direction.

A fixing unit 22 is disposed downstream from the photoconductor 10 in the sheet conveying direction. The fixing unit 22 includes a pair of fixing rollers (fixing roller bodies) 30 and 32. A fixing heater is disposed inside the fixing roller 30 and a pressure spring and a pressure arm are disposed around the fixing roller 32. Due to pressure applied from the pressure spring and the pressure arm, the fixing roller 32 is pressed against the fixing roller 30. The fixing roller 30 includes a thermistor and a thermostat.

Based on the temperature of the fixing roller 30 measured by the thermistor, the thermostat turns the fixing heater on or off. According to this operation, the fixing roller 30 is maintained at a given constant temperature.

A sheet discharging/separating claw 34, a sheet discharging roller 35, a first pressure roller 36, a second pressure roller 37, and a decurl roller 38 are disposed downstream from the fixing unit 22. The sheet discharging roller 35, the first pressure roller 36, the second pressure roller 37, and the decurl roller 38 function as a decurl mechanism that causes the sheet S to be slightly curved for preventing the sheet S from being curled in the sheet discharging stacker 39. The sheet discharging stacker 39, which corresponds to the sheet discharging position, is disposed beyond these components in the sheet conveying direction, so that a sheet with an image fixed thereto is discharged thereto.

The image forming mechanism 100 includes a switchback unit 42 and a sheet conveying unit D on the right side of FIG. 1.

The switchback unit 42 includes a sheet reversing path R3. The sheet reversing path R3 branches from the sheet discharging/separating claw 34 of the sheet conveying path R5 to a switchback position 44 that includes a switchback roller pair 43.

The sheet conveying unit D includes a re-entry path R4 that extends from the switchback position 44 to guide the sheet to the registration roller pair 21 disposed in the sheet conveying path R5. The sheet conveying unit D includes multiple sheet conveyance rollers 66 functioning as sheet conveying rollers to convey the sheet forward.

A laser writing unit 47 is disposed on the left side of the development unit 12 in FIG. 1. The laser writing unit 47 includes a laser light source, a rotational polygon minor 48 for scanning, a polygon motor 49, and optical scanning system 50 including an f-θ (f-theta) lens.

The image reading mechanism 200 includes a light source 53, multiple mirrors 54, an optical imaging lens 55, and image sensor 56 such as charge coupled device (CCD). A contact glass 57 is provided on an upper surface of the image reading mechanism 200.

The ADF 400 is placed on the contact glass 57 and includes a document loading tray to place an original document on a given document loading position. The ADF 400 includes a document discharging tray at an original document discharging position and a document conveying unit that includes a document conveying path through which a sheet such as an original document is conveyed from the document loading tray to the document discharging tray via a document reading position on the contact glass 57 of the image reading mechanism 200. The document conveying unit includes multiple sheet conveying rollers by which the sheet such as the document is conveyed.

The sheet feeding mechanism 300 includes multiple sheet separating units 61 arranged along a vertical direction. The respective sheet separating units 61 correspond to sheet feeding positions of the sheet S. Each sheet separating unit 61 includes a pickup roller 62 and a feed roller 63, both functioning as sheet feed rollers, and a reverse roller 64 functioning as a separation roller. The sheet feeding path R1 is defined on the right side of the sheet separating units 61 disposed in the vertical direction in FIG. 1 to the sheet conveying path R5 of the image forming mechanism 100.

The manual bypass feeder 73 is disposed openably closable to a right side surface of the apparatus body 101 of the image forming apparatus 1000 in FIG. 1. The manual bypass feeder 73 includes a bypass tray 67, on which a sheet feeding position is located. The bypass tray 67 functions as a sheet bypass member of the manual bypass feeder 73 to open and close with respect to the apparatus body 101. At the same time, the manual bypass feeder 73 includes the bypass sheet feeding path R2 that guides a sheet placed on the bypass tray 67 to the sheet conveying path R5. The bypass tray 67 includes a pickup roller 62 and the feed roller 63, both functioning as a sheet feed roller, and the reverse roller 64.

With reference to FIG. 1, a description is given of an image forming operation of the image forming apparatus 1000 having the structure described above to form a color toner image on a recording medium S.

To produce a copy of an image of an original document, a main switch is pressed and an original document is set on the ADF 400. Alternatively, the automatic document feeder 400 is opened to place the original document directly on the contact glass 57 of the image reading mechanism 200. Closing the ADF 400 presses the original document on the image reading mechanism.

As the start button is pressed, the sheet conveying roller causes the document set on the ADF 400 to pass through a document conveying path. After the document has moved to the contact glass 57, the image reading mechanism 200 is driven to read image data of the document and discharge the document to the document discharging tray.

By contrast, the image reading mechanism 200 is driven immediately after the document is on the contact glass 57 directly.

When the image reading mechanism 200 is driven, the light source 53 is moved along the contact glass 57. Light emitted from the light source 53 is reflected on a document surface placed on the contact glass 57. The reflected light is then reflected by the multiple mirrors 54 and passes through the optical imaging lens 55. Then, the light enters the image sensor 56, so that the image sensor 56 reads data on the document surface of the document.

At the same time, a photoconductor drive motor rotates the photoconductor 10. In the configuration of the image forming apparatus 1000 illustrated in FIG. 1, as the photoconductor 10 rotates, the charger 11 uniformly charges the surface of the photoconductor 10. Then, based on image data obtained by the image reading mechanism 200, the laser writing unit 47 emits the laser light to optically write an electrostatic latent image on the charged surface of the photoconductor 10. Thereafter, the development device 12 supplies toner to the surface of the photoconductor 10 to develop the electrostatic latent image to a visible toner image.

At the same time the start switch is pressed, the sheet S is fed by the pickup roller 62 from a corresponding one of the sheet separating units 61 disposed in the vertical direction in the sheet feeding mechanism 300. Subsequently, the feed roller 63 and the reverse roller 64 separate the sheet S from the subsequent sheets accommodated in the sheet separating unit 61. The sheet S is fed and conveyed in the sheet feeding path R1 and guided to the sheet conveying path R5 by the sheet conveyance roller 66. The sheet S then abuts against the registration roller pair 21 to stop there. In synchronization with movement or rotation of the photoconductor 10 with the visible toner image formed on the surface thereof, the registration roller pair 21 is rotated to convey the sheet S to the right side of the photoconductor 10 in FIG. 1.

Alternatively, the bypass tray 67 that functions as a manual bypass of the manual bypass feeder 73 is opened. The sheet S is set on a sheet loading surface of the bypass tray 67 and fed forward by the pickup roller 62. The feed roller 63 and the separation roller 64 separate the sheet S from the subsequent sheets to convey the sheet S into the bypass sheet feeding path R2. Then, the sheet conveyance roller 66 conveys the sheet S to guide the sheet S to the sheet conveying path R5. Thereafter, similar to the sheet S fed from the sheet separating unit 61, the sheet S fed from the bypass tray 67 is conveyed to the right side of the photoconductor 10 at the registration roller pair 21 in FIG. 1 in synchronization with rotation of the photoconductor 10.

Then, the transfer unit 13 including the transfer belt 17 transfers the image formed on the surface of the photoconductor 10 onto the sheet S sent to the right side of the photoconductor 10 at the transfer position B to form the image on the sheet S.

Residual toner remaining on the surface of the photoconductor 10 after image transfer by the transfer unit 13 is removed by the cleaning unit 14. Then, an electric charge remover removes residual charge remaining on the surface of the photoconductor 10, so that the photoconductor 10 is prepared for the subsequent image forming operations that start from the charging by the charger 11.

By contrast, the sheet S after receiving the image from the transfer unit 13 is conveyed by the transfer belt 17 and passes through the fixing roller pair 30 and 32 of the fixing unit 22 to fix the image to the sheet S by application of heat and pressure in the fixing unit 22. After passing through the fixing unit 22, the sheet S is slightly curved while passing through the sheet discharging roller 35, the first pressure roller 36, the second pressure roller 37, and the decurl roller 38 of the decurl mechanism to prevent the sheet S from remaining curled in the sheet discharging stacker 39, and then is discharged and stacked on the sheet discharging stacker 39. To form images on both sides of the sheet S, the sheet discharging/separating claw 34 is switched to a position for duplex printing. The sheet S having an image on one side is fed from the sheet conveying path R5 and conveyed to the sheet reversing path R3. The sheet conveyance roller 66 further conveys the sheet S to guide the sheet S to the switchback position 44. At the switchback position 44, the sheet S is switched back to enter the re-entry path R4. Then, the sheet conveyance roller 66 conveys the sheet S to the sheet conveying path R5 again. Thereafter, similar to the above-described operation, the image is transferred onto the back side of the sheet S.

Figure 2:
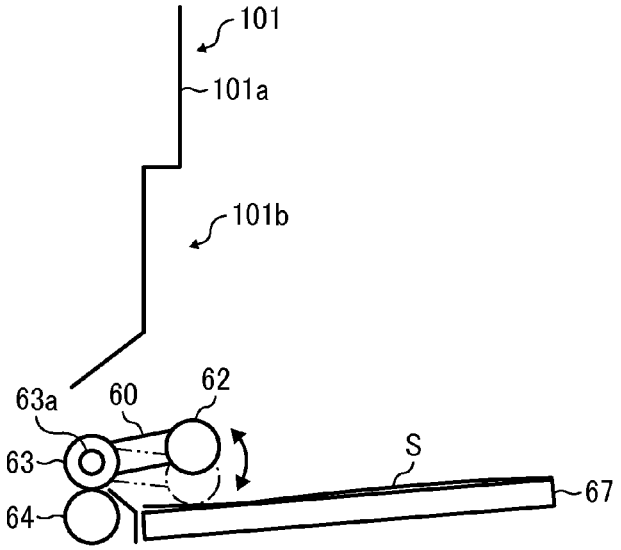
FIG. 2 is a conceptual diagram illustrating a configuration of a manual bypass feeder of the image forming apparatus according to Embodiment 1.
Figure 3:
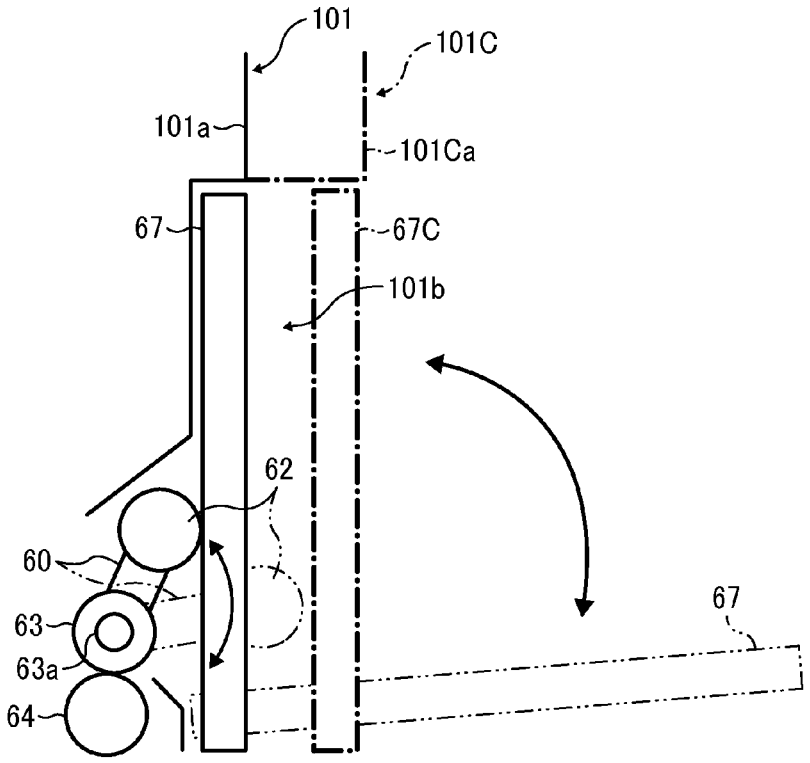
FIG. 3 is a conceptual diagram illustrating movement of the manual bypass feeder according Embodiment 1, comparing with a comparative configuration.

A description is given of a configuration of the manual bypass feeder 73 according to Embodiment 1, with reference to FIGS. 2 and 3.

FIG. 2 illustrates a configuration of the manual bypass feeder 73 functioning as a recording medium storing unit of the image forming apparatus 1000 according to Embodiment 1. FIG. 3 is a conceptual diagram illustrating movement of the manual bypass feeder 73 according Embodiment 1, comparing with a comparative configuration.

The apparatus body 101 includes an apparatus side wall 101*a* that has a recessed portion 101*b*. The bypass tray 67 of the manual bypass feeder 73 is provided openably closable to the recessed portion 101*b*. FIG. 2 shows a state in which the bypass tray 67 is open and has the sheet S loaded on the sheet loading surface of the bypass tray 67. It is to be noted that the bypass tray 67 can be a unit that can load a single sheet S or a unit that can load multiple sheets S.

The pickup roller 62 is attached to a pickup arm 60. A drive unit such as a solenoid causes the pickup arm 60 to rotate from an arm standby position (i.e., a position indicated by a solid line) to a sheet feeding position (i.e., a dotted line), so that the pickup roller 62 contacts the sheet S placed on the sheet loading surface of the bypass tray 67. By linking with the drive unit, the pickup roller 62 rotates to convey the sheet S to a nip area formed between the feed roller 63 and the separation roller 64 for a subsequent sheet feeding operation. When the multiple sheets S are fed and conveyed to the nip area, the feed roller 63 and the separation roller 64 separate the sheets S one by one using a known sheet separation technique, so that the single sheet S can be conveyed further to perform the subsequent process. A rotation center of the pickup arm 60 is located at a position downstream from a rotation center of the bypass tray 67 in the sheet conveying direction.

In the configuration of the manual bypass feeder 73 illustrated in FIG. 2, the pickup arm 60 rotates about a drive shaft 63*a* of the feed roller 63. However, the configuration of the manual bypass feeder 73 is not limited thereto. For example, the manual bypass feeder 73 can include a configuration in which the pickup arm 60 rotates about a different shaft or moves in a horizontal direction.

Alternatively, different from the bypass tray 67 that opens and closes with respect to the apparatus body 101 of the image forming apparatus 1000, the manual bypass feeder 73 can include a bypass tray that moves in a vertical direction. In this case, the bypass tray 67 can adjust the height of the position of the sheet S on the bypass tray 67 so as to contact the pickup roller 62 without changing the position of the pickup roller 62.

A schematic structure of the manual bypass tray 73 and the apparatus body 101 according to Embodiment 1 and a comparative structure having an apparatus body 101C are shown in FIG. 3. The structure of the manual bypass tray 73 according to Embodiment 1 includes the bypass tray 67 and the apparatus body 101 having the apparatus side wall 101*a* and the recessed portion 101*b*, and the comparative structure includes a bypass tray 67C and the apparatus body 101C having an apparatus side wall 101Ca.

If no sheet S is loaded on the bypass tray 67, the bypass tray 67 can be closed and stored in the recessed portion 101*b*. By rotating the bypass tray 67 from the sheet feeding position (i.e., a position indicated by a dotted line in FIG. 3) to approach a tray storing position (i.e., a position indicated by a solid line in FIG. 3) of the apparatus body 101, the bypass tray 67 can be stored in the recessed portion 101*b*, which is a space provided to the apparatus body 101 for the bypass tray 67 to be retreated, as illustrated in FIG. 3. This structure can prevent the bypass tray 67 from projecting outward from the apparatus side wall 101*a* and reduce the size of the image forming apparatus 1000 to a more compact apparatus.

Specifically, in the structure according to Embodiment 1, when closing the bypass tray 67 by causing the bypass tray 67 to approach the recessed portion 101*b* of the apparatus body 101, the pickup arm 60 moves from the arm standby position (i.e., a position indicated by a dotted line in FIG. 3) and retreats to an arm retreat position (i.e., a position indicated by a solid line in FIG. 3) in the recessed portion 101*b*. As a result, the bypass tray 67 is stored in the recessed portion 101*b* of the apparatus body 101.

By contrast, in the comparative structure, when the bypass tray 67C is closed, the pickup roller remains at the same position. Therefore, movement of the bypass tray 67C ranges from the sheet feeding position, which is the same as the structure according to Embodiment 1, to a position the bypass tray 67C contacts the pickup roller 62, which is a position indicated by a dot-dashed line in FIG. 3.

While the pickup roller 62 in the structure of the manual bypass tray 73 according to Embodiment 1 rotates, the pickup roller provided in the comparative structure does not rotate, and therefore the bypass tray 67C projects outward to the right side of the apparatus body 101C. As a result, the size of the whole size of the apparatus body 101C is greater than the apparatus body 101. Accordingly, the structure according to Embodiment 1 can reduce the size of the image forming apparatus 1000 by an amount of difference of depths between the apparatus body 101 and the apparatus body 101C.

A detailed description is given of the configuration of the manual bypass feeder 73 according to Embodiment 1, with reference to FIGS. 4 through 8.

Figure 4:
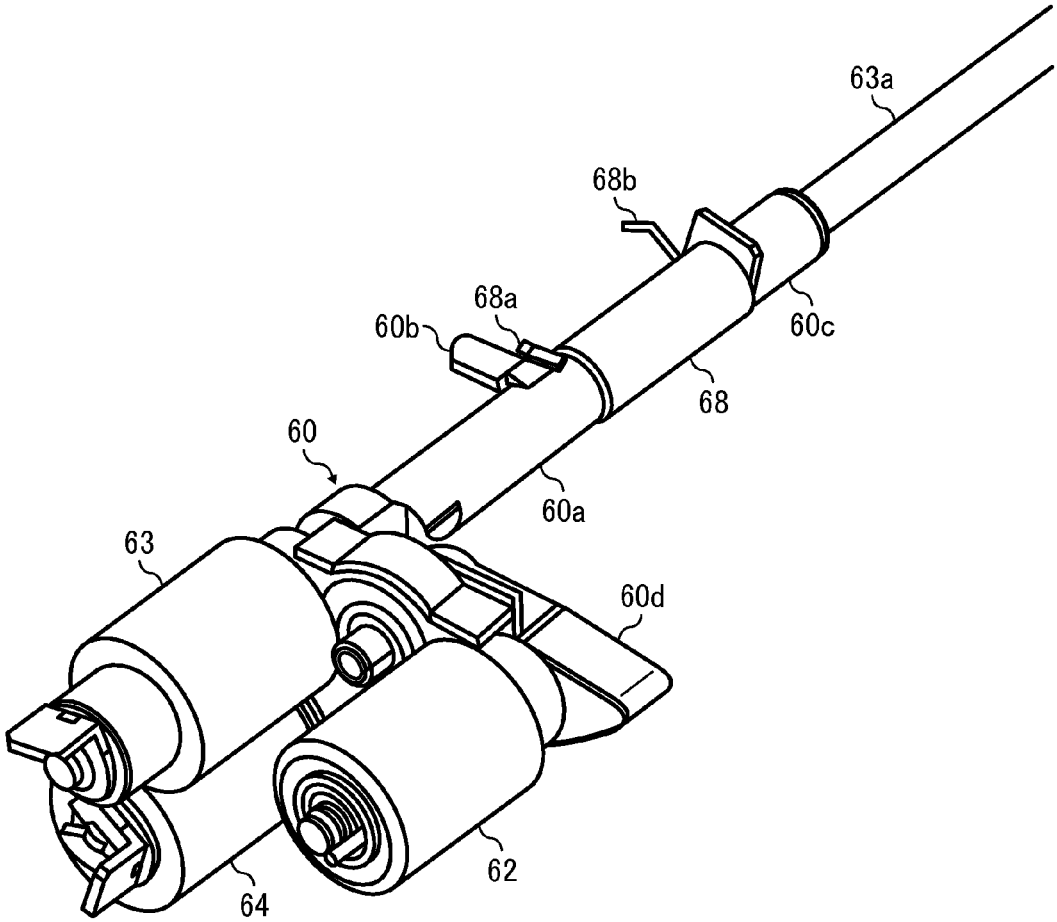
FIG. 4 is a perspective view illustrating a pickup arm and a region adjacent to the pickup arm according to Embodiment 1.

FIG. 4 is a perspective view illustrating the pickup arm 60 and a region adjacent to the pickup arm 60 according to Embodiment 1. As illustrated in FIG. 4, the pickup arm 60 includes a tubular portion 60*a* that extends in a coaxial direction of the drive shaft 63*a* of the feed roller 63. The tubular portion 60*a* rotates about the drive shaft 63*a*. A torsion spring 68 is provided around the tubular portion 60*a*. The tubular portion 60*a* has two opposite ends, which are one end 68*a* that is attached to the tubular portion 60*a* and the other end 68*b* that is attached to and hooked on a fixing portion provided to the apparatus body 101. The torsion spring 68 applies a biasing force to the tubular portion 60*a*. As a result, the pickup roller 62 attached to the pickup arm 60 is pressed against the sheet S.

The pickup arm 60 further includes a latch projection 60*b*. To keep the pickup arm 60 at the arm standby position, a stopper provided to the apparatus body 101 holds the latch projection 60*b* of the pickup arm 60. For example, the stopper may be movable in a vertical direction to specify a range of rotation or movement of the pickup arm 60. By so doing, a height of the pickup roller 62 can be moved and adjusted at sheet feeding.

The torsion spring 68 is supported and held by the pickup arm 60 and a spring bearing 60*c* that is provided to the pickup arm 60. It is preferable that a space is provided between the torsion spring 68 and the tubular portion 60*a* at a substantially center portion of the torsion spring 68 in an axial direction thereof. This configuration having the space therein can avoid increasing the diameter of the torsion spring 68 for obtaining a space between the torsion spring 68 and the drive shaft 63*a* after winding the torsion spring 68 directly to the drive shaft 63*a* of the feed roller 63. According to this configuration, the inner diameter of the torsion spring 68 can be reduced, thereby enhancing space saving.

As described above, the configuration of the manual bypass feeder 73 includes the torsion spring 68 but is not limited thereto. For example, a tension spring can be applied to lift the pickup arm 60 upward. However, since an arm shaped member is generally more rotatable than a non-arm shaped member, a tension spring may need a length longer than that of a torsion spring. Therefore, the torsion spring can save more space in an apparatus than the tension spring. It is to be noted that the configuration of the manual bypass feeder 73 according to Embodiment 1 can employ any one of the torsion spring and the tension spring.

The pickup arm 60 further includes a tip contact portion 60*d* that extends more outward than the pickup roller 62 toward the bypass tray 67, which is to the right in FIG. 4. Viewed from the drive shaft 63*a* functioning as a rotation shaft of the pickup arm 60, the tip contact portion 60*d* is arranged to contact the sheet loading surface of the bypass tray 67 at an acute angle. In FIG. 4, the pickup arm 60 is located at the arm standby position. The tip contact portion 60*d* has a lower portion, which is a portion that indicates a lower part thereof in the state that the pickup arm 60 is at the arm standby position, in a slope shape decreasing toward the apparatus body 101. The leading edge of the tip contact portion 60*d* has a curved surface protruding toward the bypass tray 67.

Figure 5:
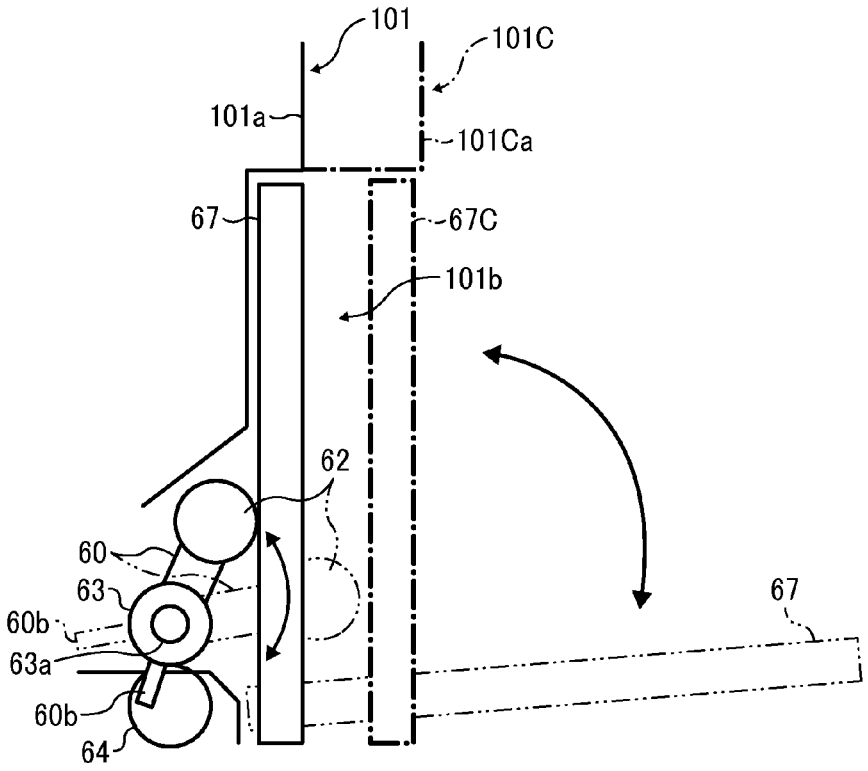
FIG. 5 is a conceptual diagram illustrating the movement of the manual bypass feeder according to Embodiment 1, comparing with the comparative configuration illustrated in FIG. 3.

FIG. 5 is a diagram illustrating movement of the manual bypass 73 according to Embodiment 1.

Same as FIG. 3, FIG. 5 shows the schematic structure of the manual bypass tray 73 and the apparatus body 101 according to Embodiment 1 and the comparative structure having an apparatus body 101C.

When closing the bypass tray 67, the bypass tray 67 is rotated in a tray storing direction, which is a counterclockwise direction in FIG. 5. Since the tip contact portion 60*d* is projected more outward than the pickup roller 62, which is to the right side in FIG. 5 and is the upward side in the sheet conveying direction), the tip contact portion 60*d* of the pickup arm 60 contacts the bypass tray 67 first.

By contacting the tip contact portion 60*d* of the pickup arm 60 to the bypass tray 67 at an acute angle, the pickup arm 60 is naturally forced to move upward along the sheet loading surface of the bypass tray 67. By so doing, the pickup arm 60 can move by linking to movement of the bypass tray 67 without providing additional drive parts or components.

Figure 6:
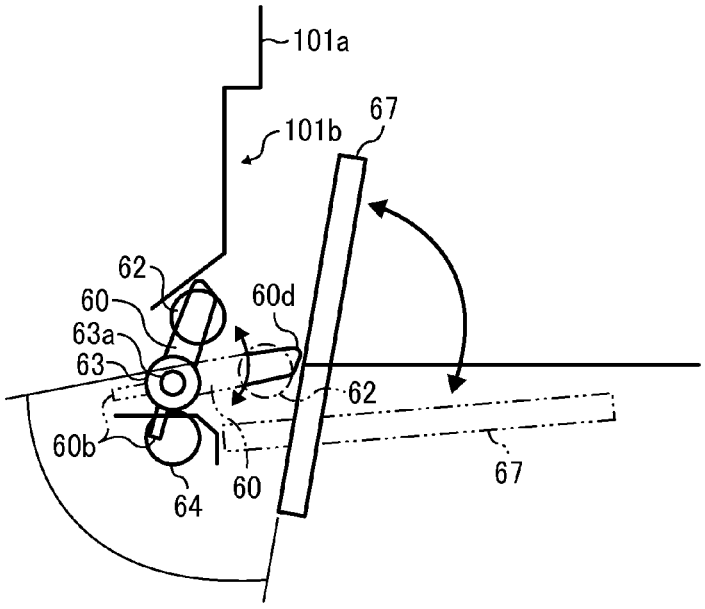
FIG. 6 is a diagram illustrating the movements of the pickup arm and a bypass tray of the manual bypass feeder.

FIG. 6 is a diagram illustrating the movements of the pickup arm 60 and the bypass tray 67.

While opening or closing the bypass tray 67, the tip contact portion 60*d* of the pickup arm 60 contacts the sheet loading surface of the bypass tray 67 at an acute angle, which is less than at 90 degrees. With this configuration, the pickup arm 60 can be lifted by closing the bypass tray 67 or be lowered to the arm standby position by opening the bypass tray 67. It is to be noted that whether or not the pickup arm 60 can link the opening/closing movement of the bypass tray 67 is determined depending on an initial contact angle or an initial angle at which the tip contact portion 60*d* contacts the sheet loading surface of the bypass tray 67 in the process of the opening/closing movement of the bypass tray 67. Accordingly, it is required to obtain the appropriate initial contact angle of the pickup arm 60 to contact the bypass tray 67 properly.

Figure 7:
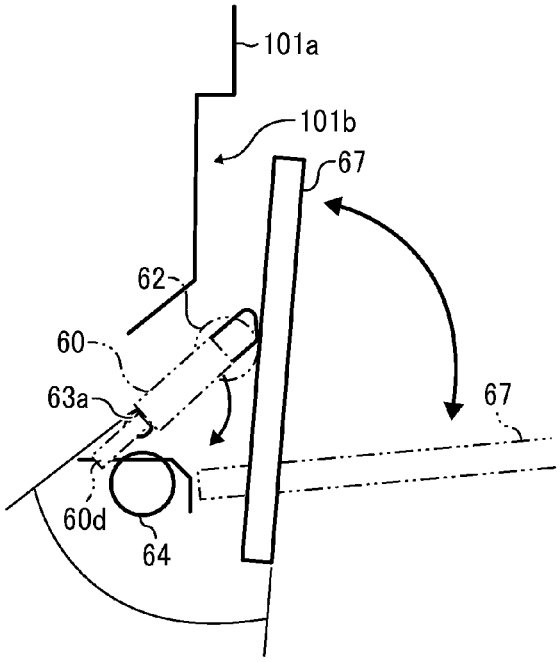
FIG. 7 is a diagram illustrating operations of movement of the pickup arm and movement of the bypass tray.

FIG. 7 illustrates a linking operation of movement of the pickup arm 60 and movement of the bypass tray 67.

As illustrated in FIG. 7, as the bypass tray 67 is closing, the pickup arm 60 is lifted. Consequently, the angle of which the tip contact portion 60*d* of the pickup arm 60 contacts the sheet loading surface of the bypass tray 67 becomes smaller and the contact resistance of the pickup arm 60 on the bypass tray 67 becomes lower. In FIG. 7, the apparatus body 101 has two steps recessed inwardly on the recessed portion 101*b*. However, the shape of the apparatus body 101 is not limited to the recessed portion 101*b* and can be applied to any other shape.

Figure 8:
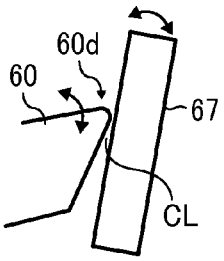
FIG. 8 is a diagram illustrating a clearance provided between a sheet loading surface of the bypass tray and a leading edge of the pickup arm when contacting the pickup arm and the bypass tray each other.

FIG. 8 illustrates the pickup arm 60 and the bypass tray 67. FIG. 8 is a diagram illustrating a clearance provided between the sheet loading surface of the bypass tray 67 and the leading edge of the pickup arm 60 when contacting the pickup arm 60 and the bypass tray 67 each other.

As illustrated in FIG. 8, it is preferable that a clearance CL is provided between the sheet loading surface of the bypass tray 67 and the surface of the curved leading edge of the tip contact portion 60*d* of the pickup arm 60 when the pickup arm 60 approaches the bypass tray 67 to start contacting the bypass tray 67. When the bypass tray 67 is rotated further to the tray storing position, a force to move the pickup arm 60 upward is generated. At this time, the clearance CL eliminates the force to avoid the large force toward the pickup arm 60. It is to be noted that, when no clearance CL is provided between the sheet loading surface of the bypass tray 67 and the surface of the curved leading edge of the tip contact portion 60*d* of the pickup arm 60, the surface of the curved leading edge of the tip contact portion 60*d* and the sheet loading surface of the bypass tray 67 contact closely, which can increase the friction force therebetween, or the curved leading edge of the tip contact portion 60*d* cuts into the sheet loading surface of the bypass tray 67, which can prevent smooth operation or movement of the pickup arm 60 and the bypass tray 67.

Further, in Embodiment 1, the pickup arm 60 includes the latch projection 60*b*. When the bypass tray 67 is stored to the tray storing position, the latch projection 60*b* of the pickup arm 60 rotates with the pickup arm 60 and moves downwardly beyond a sheet conveying surface, which is a surface extending in a line connecting the bypass tray 67 and a nip area formed between the feed roller 63 and the separation roller 64. That is, the latch projection 60*b* projects toward the separation roller 64. This configuration prevents the sheet S from being conveyed by mistake. It is to be noted that, even though the latch projection 60*b* projects downwardly beyond the sheet conveying surface, the latch projection 60*b* does not contact or abut against the rollers such as he separation roller 64.

However, it is to be noted that there may be a case that a member located on the sheet conveying surface is cut out to avoid interference with the pickup arm 60. By so doing, even when the amount of rotation of the bypass tray 67 and the amount of rotation of the pickup arm 60 increase, interference of the pickup arm 60, specifically, the tip of the pickup arm 60 with the apparatus body 101 can be avoided.

Further, the bypass tray 67 and the pickup arm 60 are rotated along a direction upper than the sheet conveying surface, and therefore the recessed portion 101*b* can be provided easily to the apparatus side wall 101*a* of the apparatus body 101.

[Embodiment 2]

Figure 9:
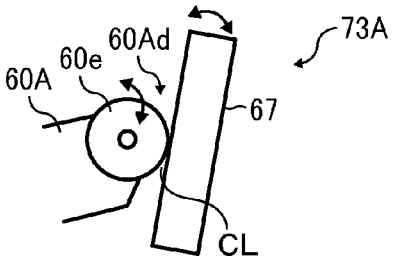
FIG. 9 is a diagram illustrating a configuration of a manual bypass feeder according to Embodiment 2.

FIG. 9 illustrates a configuration of a manual bypass feeder 73A according to Embodiment 2.

The manual bypass feeder 73A according to Embodiment 2 includes a pickup arm 60A that includes a roller 60*e* at a tip contact portion 60Ad thereof. With this configuration, when the pickup arm 60A contacts the sheet loading surface of the bypass tray 67, a more load applied on the pickup arm 60A can be reduced compared with the load applied on the pickup arm 60 of Embodiment 1. Further, the bypass tray 67 is further rotated forth toward the tray storing position, a friction force of the pickup arm 60A to the sheet loading surface of the bypass tray 67 is reduced. Therefore, the pickup arm 60A can move upward smoothly and damage to the bypass tray 67 caused when the pickup arm 60A contacts the sheet loading surface of the bypass tray 67 can be prevented. It is to be noted that the pickup roller 62 can be lifted up while the pickup roller 62 is directly contacting the sheet loading surface of the bypass tray 67. In this case, however, it is to be noted that a rotation load of the pickup roller 62 increases.

It is to be noted that the present invention is not limited to the above-described embodiment but modifications based on the above-described embodiments can be applied by an ordinary skilled person in the art within the technical idea of the present invention.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet feeder comprising:

a sheet bypass member rotatable closable with respect to a side of a body of the sheet feeder;

a roller to feed a sheet loaded on the sheet bypass member; and an arm to hold the roller and to close together with the roller to the body, the arm including a contact portion extending toward an upstream side from the roller in a sheet conveying direction of the sheet bypass member, wherein, with the sheet bypass member in an open position, the sheet bypass member is separated from the contact portion, wherein, as the sheet bypass member approaches the body, the contact portion of the arm contacts the sheet bypass member.

2. The sheet feeder according to claim 1, wherein, as the sheet bypass member approaches the body, the contact portion of the arm contacts the sheet bypass member to rotate the arm upward to cause the sheet bypass member to approach to the body.

3. The sheet feeder according to claim 1, wherein with the sheet bypass member in an open position, the contact portion is above a sheet loading surface of the sheet bypass member.

4. The sheet feeder according to claim 1, wherein the contact portion of the arm is provided at a leading edge of the arm.

5. The sheet feeder according to claim 3, wherein the sheet loading surface of the sheet bypass member is a surface on which a sheet is loaded, wherein the contact portion of the arm contacts the sheet loading surface of the sheet bypass member at an acute angle when the sheet bypass member is stored to the body.

6. The sheet feeder according to claim 1, wherein a rotation center of the arm is located at a position downstream from a rotation center of the sheet bypass member in the sheet conveying direction.

7. The sheet feeder according to claim 3, wherein a clearance is provided between the contact portion of the arm and the sheet loading surface of the sheet bypass member when the contact portion of the arm approaches the sheet bypass member to start contacting the sheet loading surface of the bypass member.

8. The sheet feeder according to claim 1, wherein the roller is directly attached to the arm.

9. The sheet feeder according to claim 1, wherein, when the sheet bypass member is open, a lower end of the roller is placed at a lower position than a lower end of the arm.

10. The sheet feeder according to claim 1, wherein the roller is attached to a side wall of the arm.

11. An image forming apparatus comprising:

a body having a recessed portion; and the sheet feeder according to claim 1 accommodated in the body.

12. The sheet feeder according to claim 1, wherein the sheet bypass manner is rotatably movable from an open position substantially perpendicular to the side body of the sheet feeder to a closed position substantially parallel to the side body of the sheet feeder.

* * * * *